US008900165B2

(12) United States Patent
Jeka et al.

(10) Patent No.: US 8,900,165 B2
(45) Date of Patent: Dec. 2, 2014

(54) BALANCE TRAINING SYSTEM

(75) Inventors: John Jeka, Serverna Park, MD (US); Peter Agada, Lanham, MD (US); Eric Anson, Laurel, MD (US)

(73) Assignee: University of Maryland, College Park, College Park, MD (US)

( * ) Notice: Subject to any disclaimer, the term of this patent is extended or adjusted under 35 U.S.C. 154(b) by 825 days.

(21) Appl. No.: 13/038,057

(22) Filed: Mar. 1, 2011

(65) Prior Publication Data

US 2011/0212810 A1 Sep. 1, 2011

Related U.S. Application Data

(60) Provisional application No. 61/309,115, filed on Mar. 1, 2010.

(51) Int. Cl.
*A61B 5/00* (2006.01)

(52) U.S. Cl.
USPC ..... 600/595

(58) Field of Classification Search
USPC ..... 600/587, 595
See application file for complete search history.

(56) References Cited

U.S. PATENT DOCUMENTS 4,416,293 A * 11/1983 Anderson et al. ..... 600/595
4,600,016 A * 7/1986 Boyd et al. ..... 600/595
4,631,676 A * 12/1986 Pugh ..... 600/595
4,813,436 A * 3/1989 Au ..... 600/592
5,209,240 A * 5/1993 Jain et al. ..... 600/592
5,476,103 A 12/1995 Nahsner
5,697,791 A 12/1997 Nashner et al.
5,830,158 A * 11/1998 Zanakis ..... 600/595
6,050,822 A 4/2000 Faughn
6,063,046 A * 5/2000 Allum ..... 600/595
6,067,986 A * 5/2000 Kluger et al. ..... 600/595
6,176,837 B1 * 1/2001 Foxlin ..... 600/595
6,461,313 B1 * 10/2002 Kampman ..... 600/587
6,645,126 B1 11/2003 Martin et al.
6,689,075 B2 2/2004 West
6,789,044 B2 * 9/2004 Claussen ..... 702/152
7,041,069 B2 5/2006 West
7,556,606 B2 7/2009 Krebs et al.
7,803,125 B2 9/2010 Santos Munne et al.
7,826,983 B2 11/2010 Alwan et al.
8,469,901 B2 * 6/2013 Teicher et al. ..... 600/595

* cited by examiner

*Primary Examiner* — Max Hindenburg
(74) *Attorney, Agent, or Firm* — Sughrue Mion, PLLC

(57) ABSTRACT

Provided is a balance training system for improving postural control of a user by providing visual feedback regarding the user's center of mass (CoM) to the user on a display. The balance training system includes a balance improvement module connected to the display, and a first sensor which captures information about a position of the user with respect to a platform of the balance training system on which platform the user is moving and which provides the captured information to the balance improvement module. The balance improvement module is configured to extract CoM information of the user from the captured information, to compare the extracted CoM information with a target area for the user's CoM on the platform, and to provide results of the comparison to the display for displaying the results to the user.

4 Claims, 10 Drawing Sheets

BALANCE TRAINING SYSTEM

CROSS-REFERENCE TO RELATED PATENT APPLICATION

This application claims priority from U.S. Provisional Application No. 61/309,115 filed on Mar. 1, 2010, the disclosure of which is incorporated herein by reference in its entirety.

BACKGROUND

1. Technical Field

Systems and methods consistent with exemplary embodiments relate to balance training, and more particularly to systems and methods for improving postural control of a user undergoing training on a balance training system while walking or running by providing visual feedback to the user on a display of the balance training system.

2. Description of the Related Art

Falling and injuries resulting from falls significantly impact the function of elderly individuals. Many older adults as well as many patient populations have balance impairments that result in loss of balance or falls. This increased risk of falling also increases the risk of injury. As the baby-boomer population continues to age, medical expenses associated with treating fall-related injuries are bound to increase. For example, the resulting impact on health care costs is substantial with non-fatal falls resulting in $19 billion in medical expenses in 2000. Moreover, individuals with a history of falling are known to reduce their participation in normal daily activities due to fear of falling. This increased sedentary lifestyle is associated with reductions in general health that further increase the risk of falling and the potential for secondary medical complications. In addition to the financial cost, quality of life for elderly fallers is diminished and they self restrict their social interactions due to fear of falling. It is prudent to identify solutions to this growing medical and economic problem.

In the related art, individuals with poor balance have several re-training options available to them, ranging from undirected practice at home to supervised community balance exercises programs to medically supervised rehabilitation using expensive computer controlled training devices and virtual reality. An advantage of high-tech computer controlled treatments over the low-tech treatments is their ability to manipulate sensory information that is important for balance control in a specific, controlled manner. Sensory information can be intentionally reduced to force utilization of other senses or increased to facilitate use of that sense. Providing sensory feedback to enhance performance is based on the principles of sensory re-weighting. Previous research has demonstrated that elderly persons and patients with impaired sensory function can learn to re-weight their sensory feedback following appropriate interventions.

SUMMARY

Embodiments of the disclosed systems and methods for balance training improve balance during walking and running by providing visual feedback regarding a subject's position on the balance training system.

Many studies have examined the benefit of visual feedback, usually in the form of center of pressure (COP) feedback during quiet standing, with mixed results related to the effectiveness of visual feedback for improving postural control. The majority of these studies indicate little or no effect on postural sway, or functional mobility behavior. However, the effect on weight shifting appears stronger. Other forms of feedback such as auditory and vibro-tactile demonstrate success in reducing postural sway during stance and locomotion primarily in the medio-lateral direction. Few studies explore the use of visual feedback during locomotion, and those limited studies are not providing visual feedback to improve postural control, rather for foot placement or appropriate assistive device use.

According to an aspect of the present invention, there is provided a balance training system for improving postural control of a user by providing visual feedback regarding the user's center of mass (CoM) to the user on a display, the balance training system including a balance improvement module connected to the display, and a first sensor which captures information about a position of the user with respect to a platform of the balance training system on which platform the user is moving and which provides the captured information to the balance improvement module, wherein the balance improvement module is configured to extract CoM information of the user from the captured information, to compare the extracted CoM information with a target area for the user's CoM on the platform, and to provide results of the comparison to the display for displaying the results to the user.

In the balance training system, the balance improvement module extracts the CoM information of the user from the captured information by tracking movement of a marker affixed to the user, and the balance improvement module periodically provides a current position of the user's CoM to the display with respect to the target area based on a current detected position of the marker.

The balance training system includes an article worn by the user or attached to the user, the article including on its exposed surfaces the marker.

In the balance training system, the balance improvement module includes a deviation determining module, the deviation determining module applied to the captured information about the position of the user with respect to the platform and the user's CoM to determine deviation information representing the user's position and corresponding points in time when the user's CoM deviates from the target area, and to provide the deviation information to the display for displaying the deviation information to the user.

In the balance training system, the balance improvement module determines power spectral density of the user's CoM information at each frequency of movement by the user.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF EXEMPLARY EMBODIMENTS

The present invention will now be described more fully with reference to the accompanying drawings, in which exemplary embodiments of the invention are shown.

Figure 1:
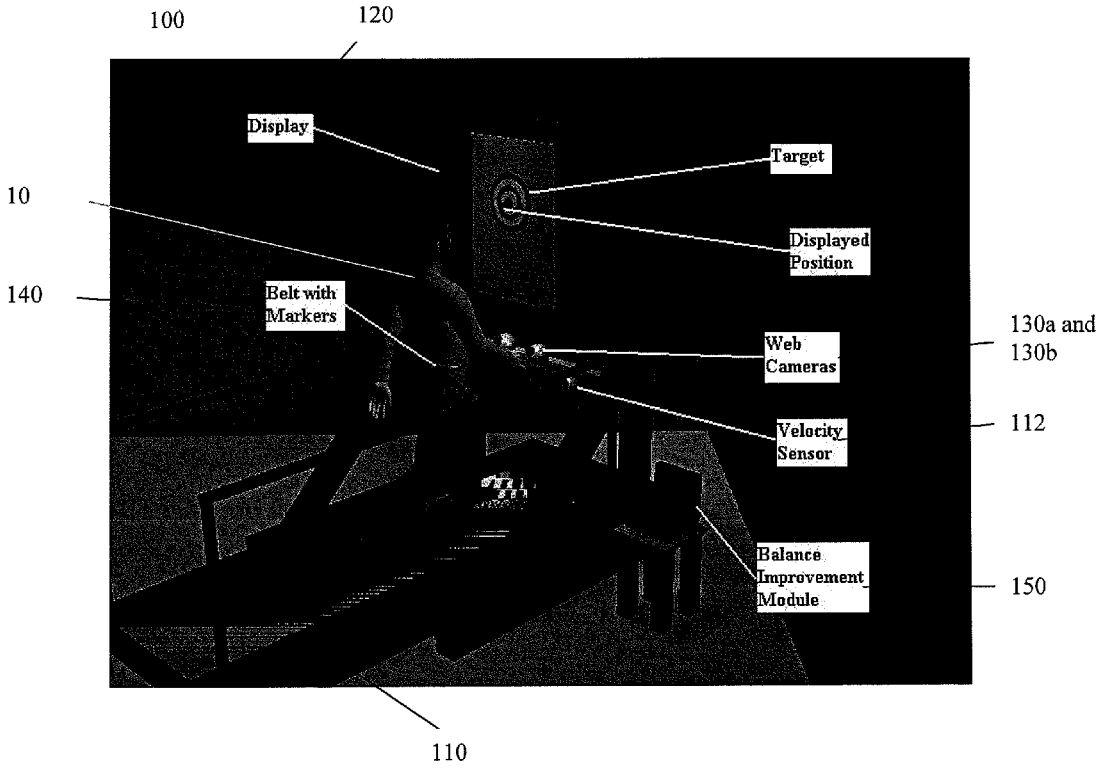
FIG. 1 illustrates a balance training system according to one exemplary embodiment.

FIG. 1 illustrates a balance training system 100 according to one exemplary embodiment. As shown in FIG. 1, the balance training system 100 includes a treadmill 110 on which a subject 10 walks or runs, a treadmill velocity sensor 112, a display 120, two image sensors 130*a* and 130*b* (employed by two web cameras, for example), a belt 140 with one or more markers worn by the subject 10 on the subject's trunk, and a balance improvement module 150 (e.g., a computer). The one or more markers included on the belt 140 can be of a predetermined shape and color (e.g., a red circle).

The balance training system 100 is flexibly designed to provide a variety of visual cues on the display 120 that can be used to improve balance control of the subject (i.e., a user) while walking or running. The subject 10 walks or runs on the treadmill 110 in front of the display 120 (e.g., a TV) while the two image sensors 130*a* and 130*b* track the one or more markers on the moving subject's trunk. Custom algorithms executed in the balance improvement module 150 convert the position and orientation of the subject's trunk through marker or shape recognition based on the information detected by the image sensors 130*a* and 130*b*. Multiple methods can be used to convert image information captured by the image sensors 130*a* and 130*b* into visual information that is most appropriate for the required task, as discussed below with reference to FIGS. 9A and 9B.

The user interface on the display 120 will allow self-selection of the type of display generated by the balance improvement module 150.

Figure 2:
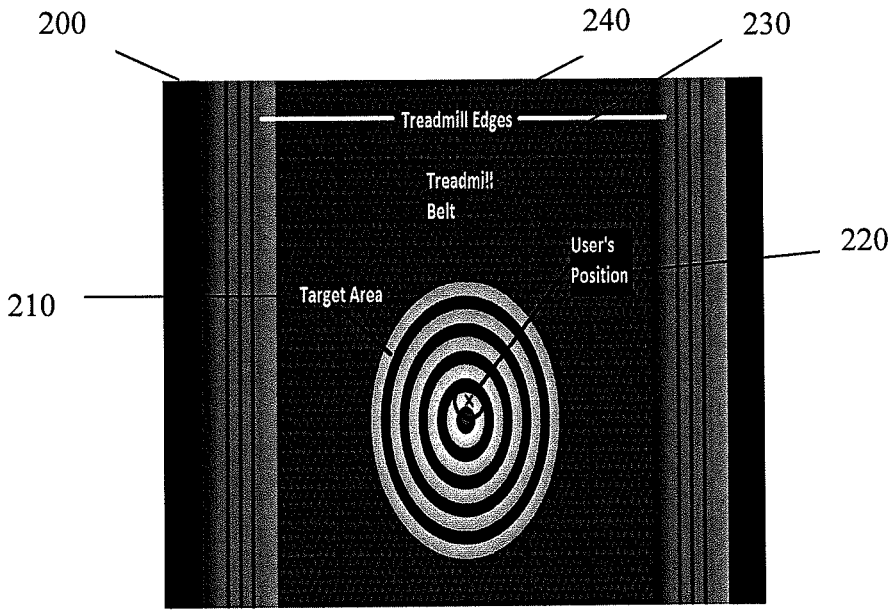
FIG. 2 illustrates one example of a user interface on the display.

FIG. 2 illustrates one example of a user interface 200 on the display 120. As shown in FIG. 2, the user interface 200 provides the subject 10 a target area 210 on the treadmill belt 230 in between the treadmill edges 240 (where the target area 210 is displayed in a top down view as a bulls-eye). The task for the subject is to keep the cursor 220 inside the target area 210 through corrections of their own body movements. The movement of the cursor 220 in this display format could be used to represent either the user's position on the treadmill belt 230 or the amount of their upper body lean or the center of mass (CoM), with the center of the target area 210 representing straight up (i.e., no body lean). Any deviation from the center would represent a change in trunk angle away from vertical.

The target area 210 on the treadmill belt 230 could be set at a single location, or designed to predictably (sinusoidal pattern-front/back or right/left) or unpredictably (random) change position on the display 120 and the subject 10 would have to follow the target motion to keep the cursor 220 inside the target area 210. Alternatively, the display could be modified to present a designated target area 210, without providing a visible cursor 220. The target area 210 would appear as one color (e.g., yellow) to indicate that the subject 10 was in the correct area, and switch to another color (e.g., blue) to indicate that the subject 10 is no longer in the desired target area.

Figure 3A:
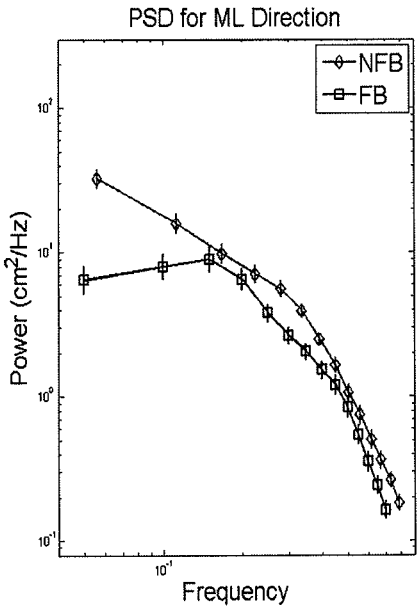
FIGS. 3A and 3B show results of an experiment with healthy young adults using the balance training system of FIG. 1 employing the user interface shown in FIG. 2 (i.e., with feedback) and results of the same experiment when no feedback is provided to these subjects.
Figure 3B:
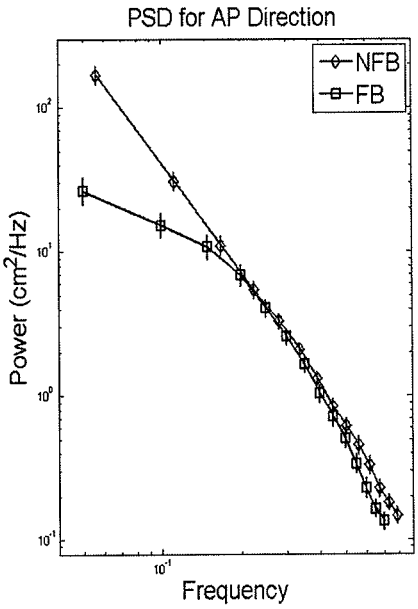

FIGS. 3A and 3B show results of an experiment with healthy young adults using the balance training system 100 of FIG. 1 employing the user interface 200 shown in FIG. 2 (i.e., with feedback) and results of the same experiment when no feedback is provided to these subjects. In particular, FIG. 3A shows power spectral density (PSD) plots of the subjects' postural sway in the Medial-Lateral (ML) direction both with feedback (FB—user interface 200) and without feedback (NFB-no user interface 200). Similarly, FIG. 3B shows power spectral density (PSD) plots of the subjects' postural sway in the Anterior-Posterior (AP) direction both with FB and NFB.

To characterize the postural behavior during FB and NFB, PSD's were computed for individual markers placed on the body of the subjects. Power spectral density characterizes the amount of movement of the CoM at each frequency of movement, with less movement (i.e., better balance) corresponding to lower power at a particular frequency.

The results (plots) show the power spectral density of the subjects' trunk movement, which separates movement into different frequencies. The results demonstrate that visual feedback decreases the amount of movement at low frequencies, providing evidence that visual information enhances control of body position on the treadmill 100, which may then translate into better overall balance control during overground locomotion.

Other exemplary embodiments of feedback displays for displaying on the display 120 would combine the image information captured by the image sensors 130*a* and 130*b* about the subject's trunk in conjunction with the subject's walking speed to create an avatar that mimics the motions of the walking/running subject 10 while moving through and interacting with virtual environments. Some possible examples of such display types would include projections of hallways that the avatar walks through. The width of the hallway could progressively become narrower; and the subject 10 would gradually have to stay within a smaller area of the treadmill belt in order to avoid the walls. Alternatively the hallway walls could remain a constant distance, but obstacles could be presented that require the user to change their position on the treadmill (i.e. by moving right or left) to avoid the obstacle to test the subject's balance during this additional movement.

Another exemplary embodiment of a feedback display would require the subject 10 to lean their upper body (right, left, forward, or backward) to either avoid an obstacle or to capture a reward while walking through a hallway. Further, other feedback displays could provide outdoor environments, such as a bridge that becomes progressively narrower, set over a river or canyon scene similar to the hallway embodiment discussed above. For displays that present an avatar, whose motion in the virtual environment is dictated by the subject's motion, the apparent motion of the virtual environment (i.e. hallway motion or environmental motion) would be matched to the speed of the treadmill using a sensor that measures treadmill belt speed. The difficulty level of any display would also be selectable by the user, for example the frequency of obstacles or rewards (display elements that require the user to move) presented on the display could be increased to make the task more difficult. The size of the obstacles would also be linked to the level of difficulty with smaller obstacles representing less difficulty and larger obstacles representing greater difficulty. This flexibility allows the subject 10 to determine the amount and type of feedback related to their performance.

Figure 4:
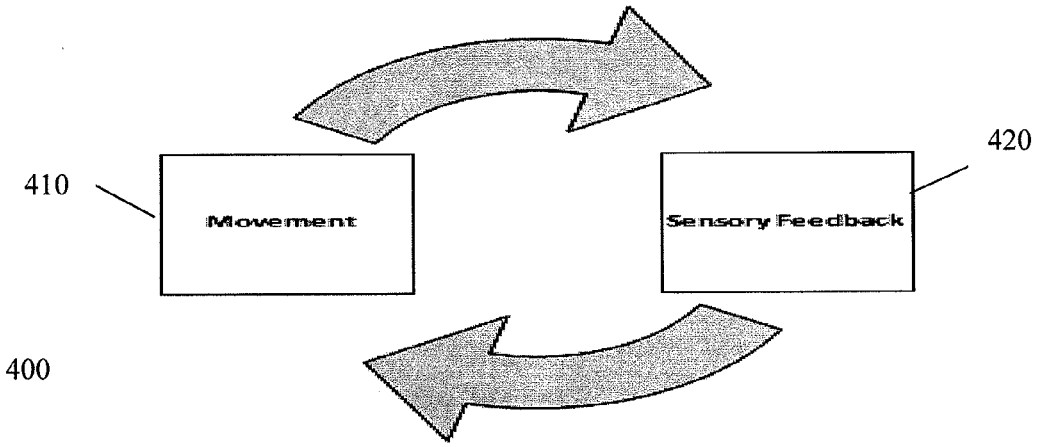
FIG. 4 illustrates a closed movement-feedback loop associated with normal movement.

FIG. 4 illustrates a closed movement-feedback loop 400 associated with normal movement. In this loop, movement 410 generates internal sensory feedback 420 that in turn drives movement without conscious attention or movement selection by the individual (e.g., the subject 10).

The balance improvement module 150 of the balance training system 100 is designed to enhance the movement-feedback loop during such movement (e.g., walking or running) The enhancement is accomplished through augmented visual feedback provided via the display 120. As described above, the subject 10 will see their performance with respect to a desired target or task (obstacle avoidance or reward capture) and can make appropriate modifications to their performance if they are not performing optimally.

Figure 5:
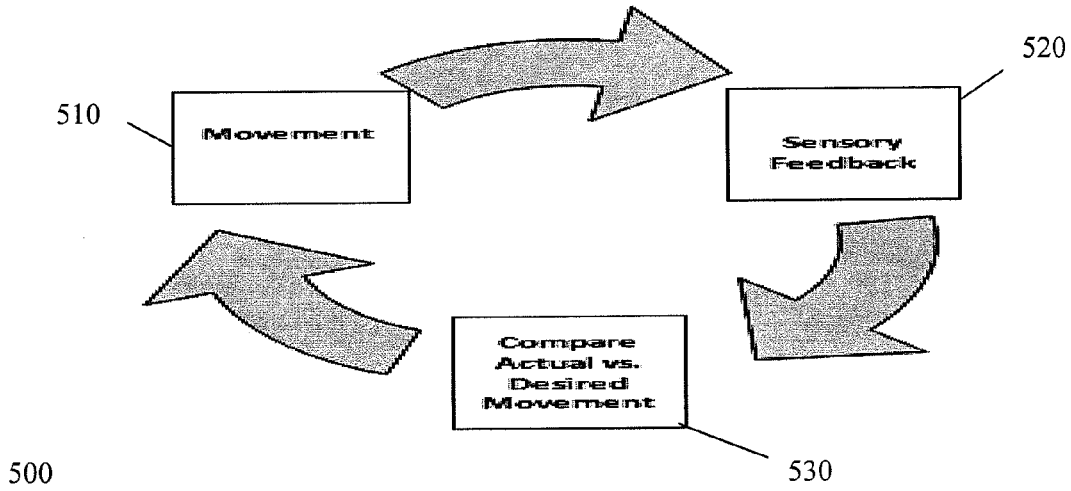
FIG. 5 illustrates an enhanced movement-feedback loop.

FIG. 5 illustrates an enhanced movement-feedback loop 500. The enhanced movement-feedback loop 500 provides the user real-time information 530 regarding their position on the treadmill or their relative upright posture compared to a target in response to movement 510, in addition to the internal sensory feedback 520 generated by the movement 510. The presentation of this augmented feedback provides the user with visual representation of their actual performance to compare with the desired performance, as discussed above with respect to FIGS. 1-3B.

As can be obvious to a skilled artisan, the balance improvement module 150 can be employed in the balance training system 100 of FIG. 1 but can also be retrofitted to any other suitable exercise machine (e.g., another treadmill).

Figure 6:
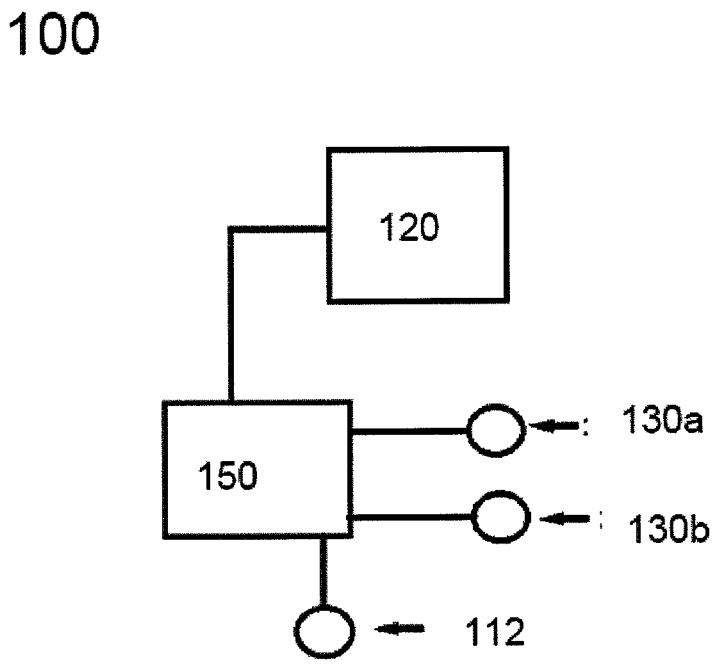
FIG. 6 illustrates the logical connections between components of the balance training system according to an exemplary embodiment.

FIG. 6 illustrates the logical connections between components of the balance training system 100 according to an exemplary embodiment. As shown in FIG. 6, image information captured by the image sensors 130*a* and 130*b* is provided to the balance improvement module 150. The balance improvement module 150 also receives as an input information from the treadmill velocity sensor 112. The balance improvement module processes this input information to provide feedback to the subject on the display 120, as will be discussed in further detail below.

Figure 7:
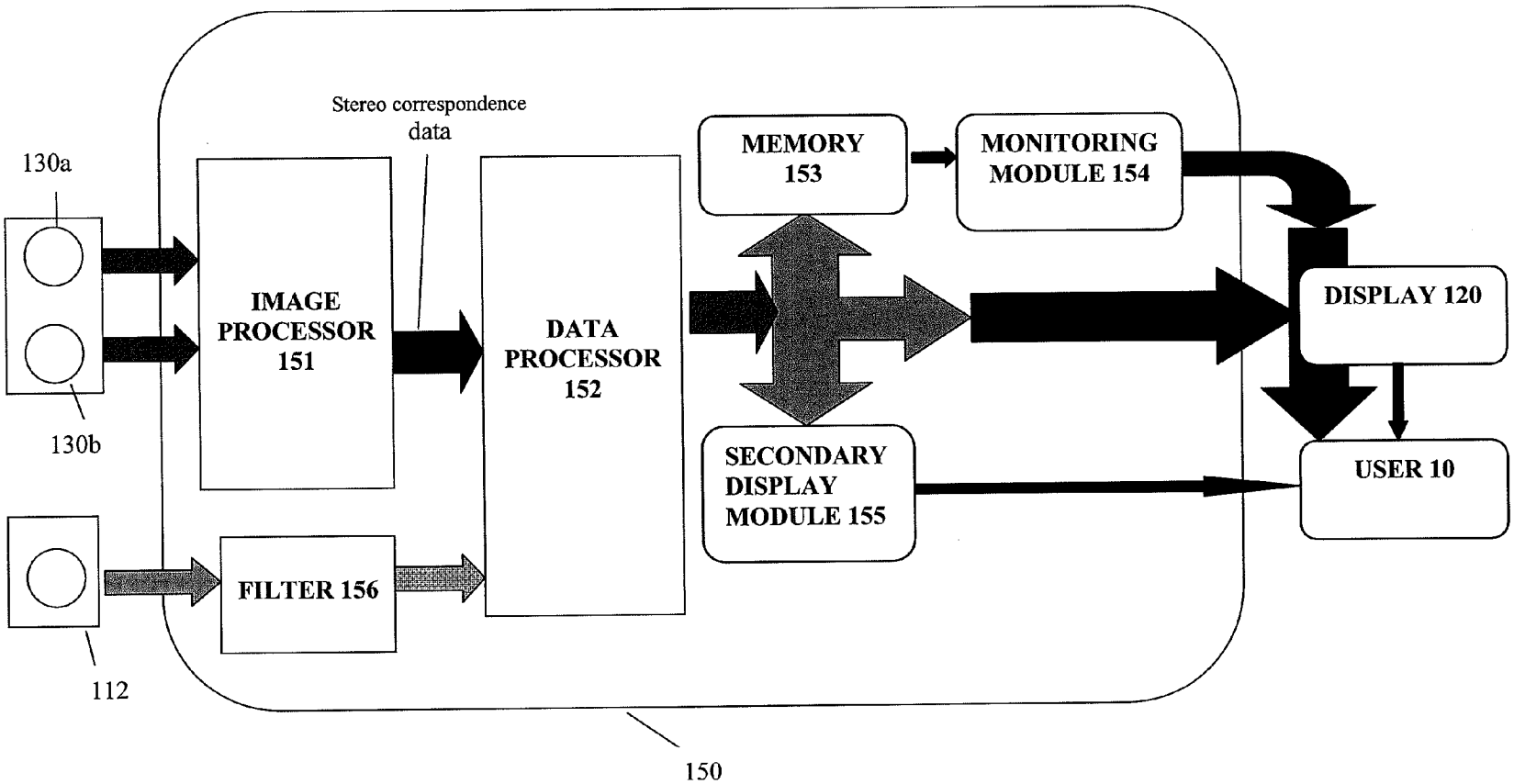
FIG. 7 illustrates a detailed configuration of the balance improvement module according to an exemplary embodiment.

FIG. 7 illustrates a detailed configuration of the balance improvement module 150 according to an exemplary embodiment. The balance improvement module is situated in a forward anterior position of a treadmill such as the treadmill 110 of FIG. 1. The image sensors 130*a* and 130*b* (forward pointing sensors) act as 2-dimensional (2D) imaging devices that capture 3-dimensional (3D) projections onto 2D image planes. The stereo pair of the image sensors 130*a* and 130*b* translate partitioned information of the full 3D scene above the treadmill surface, in the form of digitized coordinates to the balance improvement module 150.

In addition to the stereo pair of the image sensors 130*a* and 130*b*, the system also compromises a third sensor 112 dedicated to measuring the velocity of the tread of the treadmill. As discussed above, this information is also forwarded to the balance improvement module 150. In order to eliminate any noise introduced from electrical sources, the electrical signal coming from the third sensor 112 is processed by a filter 156 (e.g., software) included in the balance improvement module 150. A variety of methods may be implemented to process the incoming signal in the filter 156 to achieve the optimal signal quality. For example, a Hough transform may be applied to the signal to determine the outline of the tread and it's subsequent velocity approximated. Once the signal has been treated (i.e., processed) in the filter 156, the processed signal is then transferred to the data processor 152 for further integration in the development of the virtual scene, for example.

The balance improvement module 150 also analyzes the signals from the image sensors 130*a* and 130*b* and velocity sensor 112 to reconstruct the 3D space of the area above the treadmill and the velocity of the treads using the image processor 151, the data processor 152, the memory 153, the monitoring module 154, the secondary display module 155, and the filter 156. In this way, the balance improvement module 150 creates digitized 3D coordinate of the space in the view of the sensor block that allows for tracking of position and orientation of objects.

Figure 8:
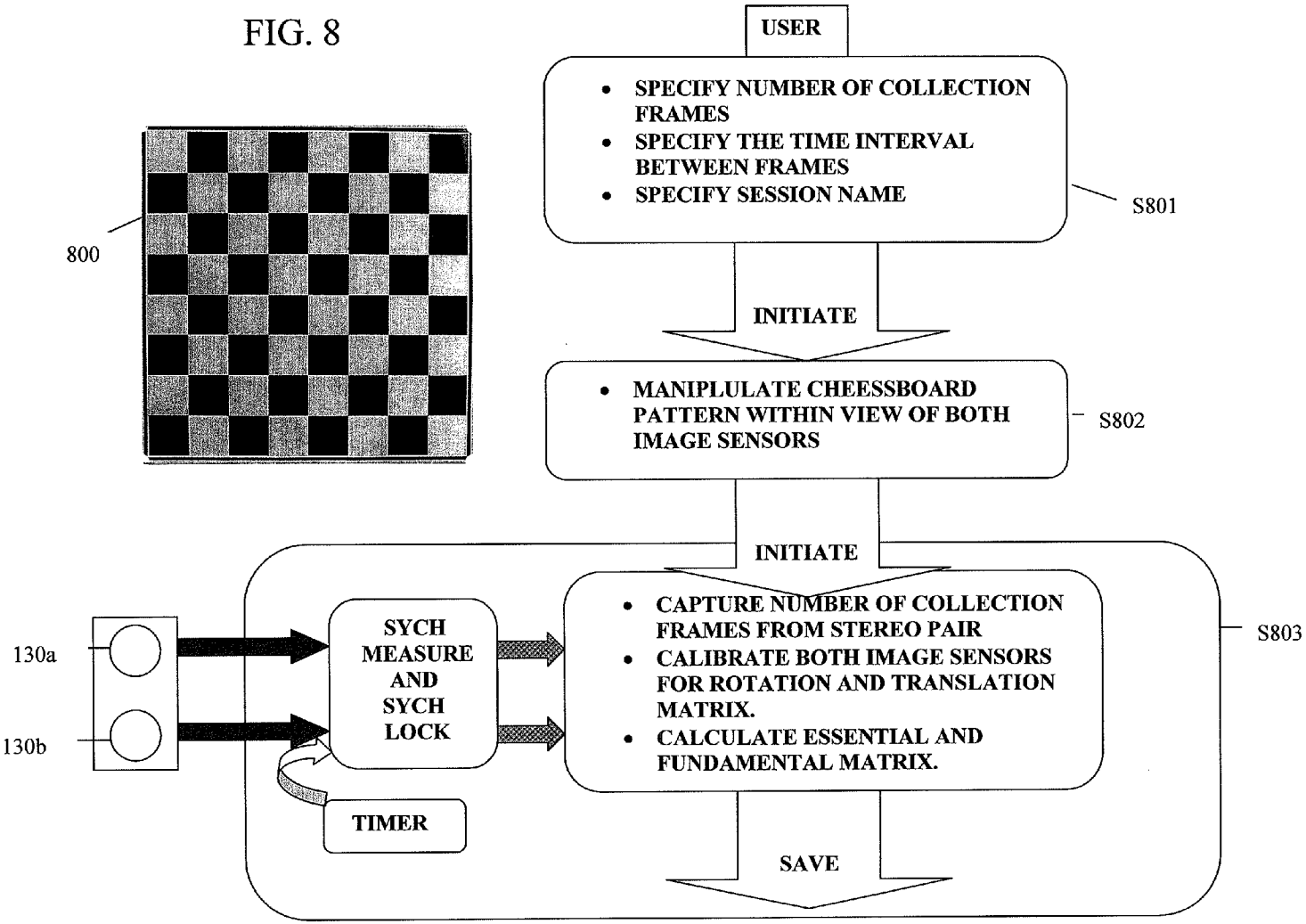
FIG. 8 illustrates a start-up sequence when a user begins using the balance training system according to one exemplary embodiment.

FIG. 8 illustrates a start-up sequence when a user begins using the balance training system according to one exemplary embodiment. As shown in FIG. 8, on start-up, the user specifies a number of collection frames, the desired time interval between the frame capture, and the session name (S801). Using a checkered pattern (e.g., pattern 800 shown in FIG. 8), the user manipulates within the view of the image sensors 130*a* and 130*b* (S802), and the balance improvement module 150 initiates a stereo calibration algorithm to calculate the relevant information required for the stereo reconstruction of the space (S803).

Figure 9A:
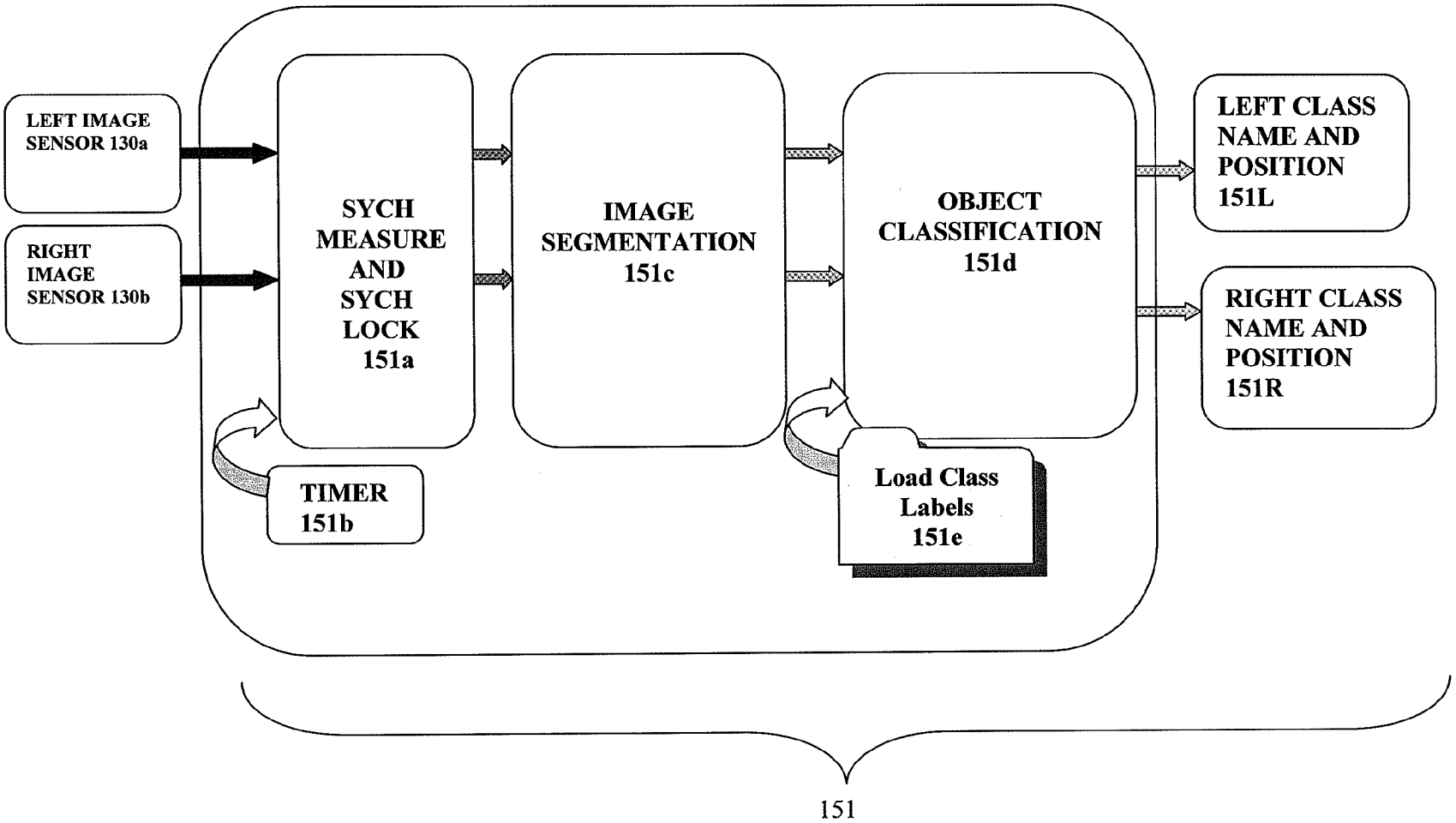
FIGS. 9A-9B detail the mechanism through which the reconstruction process is achieved by the balance improvement module, in the situation depicted in FIG. 1 with a subject wearing a belt with one or more colored markers on the front of the belt.
Figure 9B:
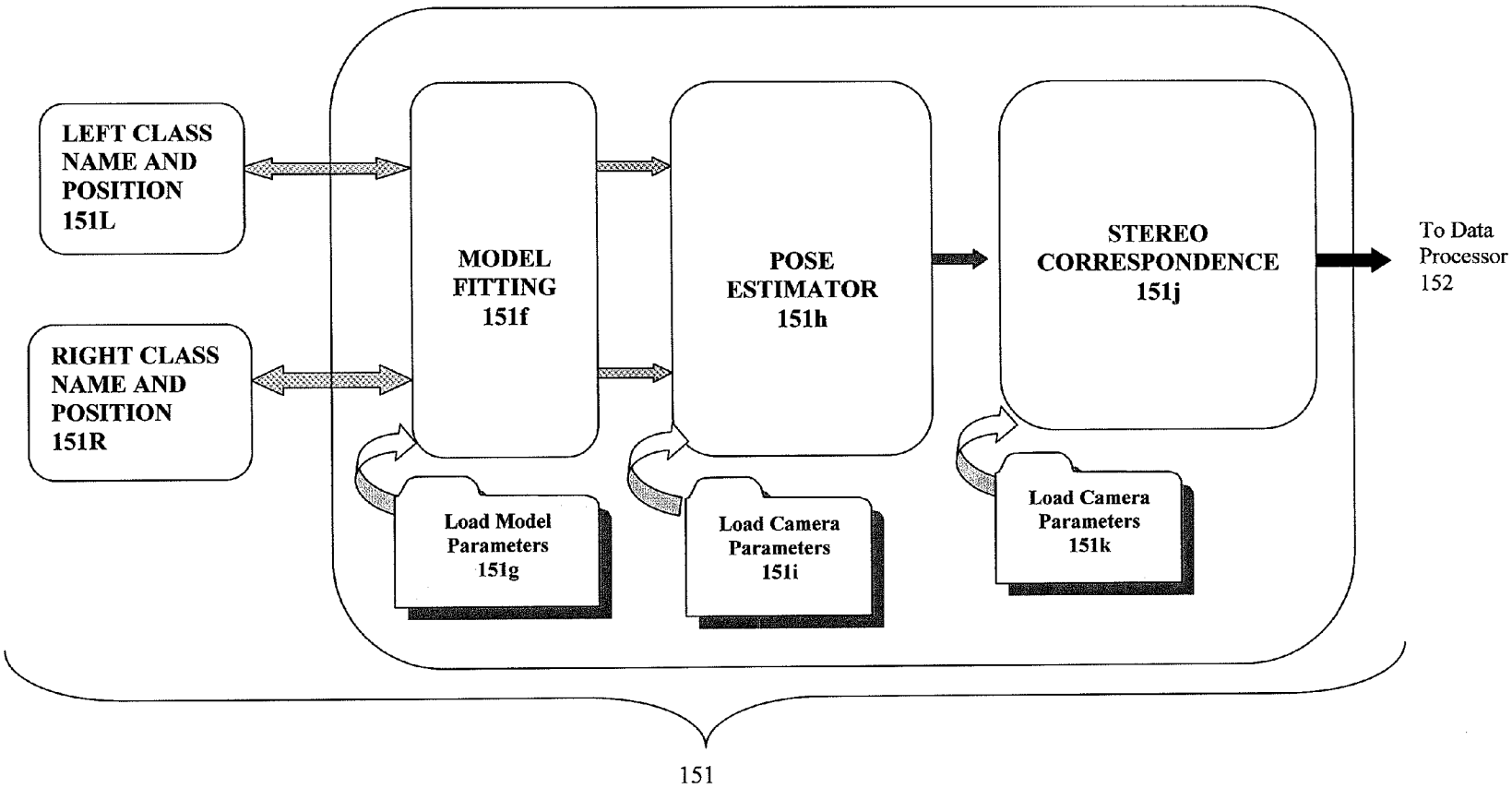

FIGS. 9A-9B detail the mechanism through which the reconstruction process is achieved by the balance improvement module 150, in the situation depicted in FIG. 1 with a subject 10 wearing a belt 140 with one or more colored markers on the front of the belt 140. The one or more colored markers can be situated at any exposed portion of the belt 140.

As shown in FIGS. 9A and 9B, the input into the image processor 151 is the information captured by the image sensors 130*a* and 130*b*. The image processor 151 includes a synchronization module 151*a*, a timer 151*b*, an image segmentation module 151*c*, an object classification module 151*d*, a class labels loading module 151*e*, a model fitting module 151*f*, a model parameters loading module 151*g*, a pose estimator 151*h*, a camera parameters loading module 151*i*, a stereo correspondence module 151*j*, and a camera parameters loading module 151*k*.

The inputted information from the image sensors 130*a* and 130*b* includes, for example, pixel coordinates XR, YR from image sensor 130*a* and pixel coordinates XL, YL from the image sensor 130*b*. To reduce any noise introduced into the reconstruction process, the stereo pair of 2D images must be acquired at the same time instance from the image sensors 130*a* and 130*b*. Therefore, the received image pairs from the image sensors 130*a* and 130*b* are checked for synchronized time stamps and adjusted accordingly to ensure that both images are being received at the same time by the synchronizing module 151*a* based on time information received from the timer 151*b*.

The synchronized images are then passed to the image segmentation module 151*c* for execution of an image segmentation algorithm to isolate the subject 10 within the image plane of both images. In particular, duplicates of the stereo images are created, one corresponding pair with the subject 10 removed from the image plane (i.e., the background) and the other with the background removed (i.e., the user and the belt will remain).

Accessing the nature of the object in the segmented images is then prioritized via the implementation of statistical classification methods by the object classification module 151*d* in order to identify some unknown object as a member of a known class of objects. Mutually exclusive class labels are loaded into the object classification module 151*d* by the class labels loading module 151*e* to facilitate this classification. If the identified object matches a predefined class, e.g., the "marker" that the balance improvement module 150 is looking for, then that class name and the corresponding pixel area are sent to the model fitting module 151*f* as left class name and position 151L and right class name and position 151R. If on the other hand, the identified object matches a predefined class, called "silhouette", then that class name and corresponding pixel area is sent to the model fitting module 151*f* as left class name and position 151L and right class name and position 151R.

The role of the model fitting module 151*f* is to create a virtual object that can be used to narrow down the scope of the analysis that is required for further processing. By loading precompiled models of a ball and an N-joint human skeleton frame (e.g., 10 joint human skeleton frame), the class name (151L and/or 151R) is used to select the appropriate model for the target (e.g., the "marker" on the belt worn by the subject) in the view of the image sensors 130*a* and 130*b*. Validation of the selected model and the object is performed using model parameters loaded by the model parameters loading module 151*g* to ensure that the appropriate model was selected and if not the object classification procedure is repeated.

By the completion of the model fitting stage by the model fitting module 151*f*, the segmented image will now have a model of either a ball over the site of the colored markers corresponding to the belt 140 or a skeleton overlaid onto the silhouette of the user. The appropriate model is then passed through a pose estimator module 151*h*, which reports the object's position and orientation relative to the 2D image sensor coordinate systems based on the camera parameters received from the camera parameters loading module 151*i*. By loading in camera parameters, that are generated through an automatic calibration routine, a pair of estimates for the translation and rotation matrices for both of the 2D sensors (e.g., the image sensors 130*a* and 130*b*), allow projection rays from the model points to be reconstructed in 3D.

Finally, the image processor 150 loads both image pairs into a stereo correspondence module 151*j* that validates and identifies identical points present in full 3D space that were transformed into the image planes. The availability of camera parameters from automatic calibration is utilized to facilitate the transformation of image points on one image plane to the other, where the camera parameters are received from the camera parameters loading module 151*k*. This final step completes the reconstruction of the full 3D position (e.g., in the x-y-z plane) of the object in the stereo pair.

After stereoscopic integration of input from each of the image sensors 130*a* and 130*b* is converted into position coordinates (x,y,z) the position of the user is tracked in real time. For position tracking, the coordinates of a single marker or location defined by a model (used with markerless tracking) serves two functions in the balance improvement module 150. The first function is to provide an input that determines the position of the cursor or avatar in the display environment, as discussed above with reference to FIG. 2. The second function of the coordinate calculation is to provide knowledge of performance to the user after the end of a balance training trial. The position data from one (position tracking) or multiple points (vertical orientation) is saved and stored in the memory 153 within the balance improvement module 150. This enables the user, a clinician, or trainer to track and monitor progress over time using a monitoring module 154 of the balance improvement module.

The balance improvement module 150 can provide the user the option to visualize their sway path (position) or degree of uprightness (orientation) following the completion of a balance training trial or repetition.

Figure 10A:
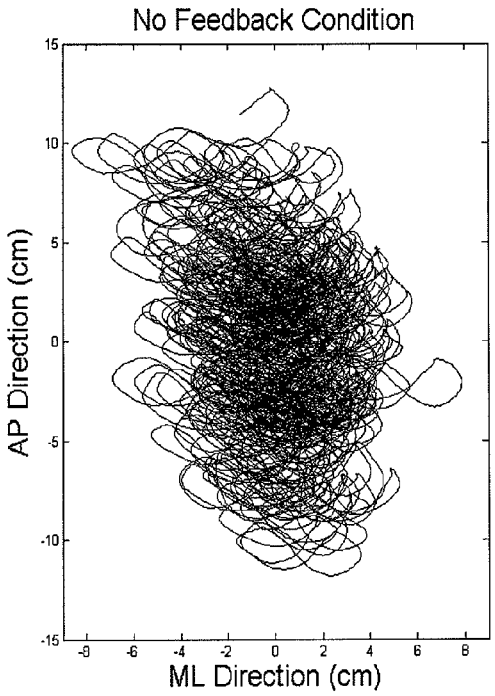
FIG. 10A illustrates a user's sway path with no feedback provided to the user during a four-minute balance training trial.
Figure 10B:
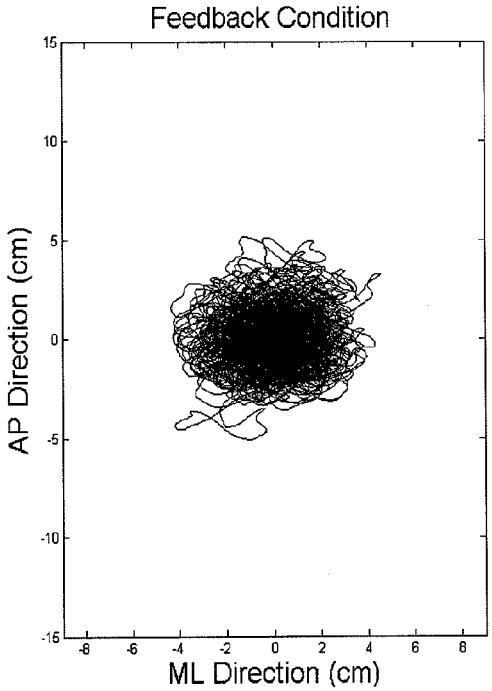
FIG. 10B illustrates the user's sway path with feedback provided to the user during a four-minute balance training trial.

FIG. 10A illustrates a user's sway path in the ML direction and AP direction with no feedback provided to the user during a four-minute balance training trial, and FIG. 10B illustrates the user's sway path in the ML direction and AP direction with feedback provided to the user during a four-minute balance training trial.

In FIGS. 10A and 10B, the area of the user's position can be calculated, and this calculated area can be used to track progress over time. The balance improvement module 150 will provide the user with the option to print out any display tracking performance or progress over multiple sessions as a way to chart the overall progress of the user, which is beneficial for clinicians who need to demonstrate objective measures of improvement.

An additional use of the position and orientation data calculated based on the user's coordinates is to provide scores and other types of feedback to the user to indicate how well they did by using the secondary display module 155 included in the balance improvement module. For example, in the user interface shown in FIG. 2, each ring can be given a score value and the user's total score can be determined by how much time is spent in each ring. For example, in a one minute trial if the center ring is worth 10 points and the user is able to maintain their position or orientation such that the cursor stays in the center ring the user would score 600 points (10 points*60 seconds with the parameters being that for each second in the center ring, the user receives 10 points). This would serve as a motivating factor for the user to improve their score. For users who would be too distracted by multiple types of feedback being presented simultaneously (some individuals with balance disorders may not be able to process all of the feedback simultaneously) the on screen points display could be turned on or off at the user's discretion.

The systems and methods described above show that by providing real-time visual feedback to users undergoing balance training, their ability to adjust their posture and movements to improve balance can be improved. This improved balance can be linked to a lower rate of falls. Thanks to its emphasis on improving balance control, one of the applications of the disclosed balance training system and method lies in the area of physical therapy, where it can be utilized to maintain and restore movement in both preventive and post-injury rehabilitation treatments. Moreover, because of the approach taken to balance control in the disclosed embodiments, the balance training system also has several potential applications in sports and fitness markets. Professional and amateurs athletes as well as health conscious individuals could improve balance control while training and/or enhancing performance.

While the present invention has been particularly shown and described with reference to exemplary embodiments thereof, it will be understood by one of ordinary skill in the art that various changes in form and details may be made therein without departing from the spirit and scope of the present invention as defined by the following claims.

What is claimed is:

1. A balance training system for improving postural control of a user by providing visual feedback regarding the user's center of mass (CoM) to the user on a display, the balance training system comprising:

a balance improvement module connected to the display; and a first sensor which captures information about a position of the user with respect to a platform of the balance training system on which platform the user is moving and which provides the captured information to the balance improvement module, wherein the balance improvement module is configured to extract CoM information of the user from the captured information, to compare the extracted CoM information with a target area for the user's CoM located on the platform, and to provide results of the comparison to the display for displaying the results to the user, wherein the first sensor captures the information about the position of the user by tracking movement of a marker affixed to the user and provides the captured information to the balance improvement module, and the balance improvement module periodically provides a current position of the user's CoM to the display with respect to the target area based on a current detected position of the marker.

2. The balance training system claim 1, further comprising:

an article worn by the user or attached to the user, the article including on its exposed surfaces the marker.

3. The balance training system of claim 1, wherein the balance improvement module comprises a deviation determining module, the deviation determining module applied to the captured information about the position of the user with respect to the platform and the user's CoM to determine deviation information representing the user's position and corresponding points in time when the user's CoM deviates from the target area, and providing the deviation information to the display for displaying the deviation information to the user.

4. A balance training system for improving postural control of a user by providing visual feedback regarding the user's center of mass (CoM) to the user on a display, the balance training system comprising:

a balance improvement module connected to the display; and a first sensor which captures information about a position of the user with respect to a platform of the balance training system on which platform the user is moving and which provides the captured information to the balance improvement module, wherein the balance improvement module is configured to extract CoM information of the user from the captured information, to compare the extracted CoM information with a target area for the user's CoM located on the platform, and to provide results of the comparison to the display for displaying the results to the user, wherein the balance improvement module determines power spectral density of the CoM information of the user at each frequency of movement by the user.

* * * * *